US006356618B1

(12) United States Patent
Fornaciari et al.

(10) Patent No.: US 6,356,618 B1
(45) Date of Patent: Mar. 12, 2002

(54) EXTREME-UV ELECTRICAL DISCHARGE SOURCE

(75) Inventors: Neal R. Fornaciari, Tracey, CA (US); Richard E. Nygren, Los Ranchos de Albuquerque; Michael A. Ulrickson, Albuquerque, both of NM (US)

(73) Assignee: EUV LLC, Santa Clara, CA (US)

( * ) Notice: Subject to any disclaimer, the term of this patent is extended or adjusted under 35 U.S.C. 154(b) by 51 days.

(21) Appl. No.: 09/594,746

(22) Filed: Jun. 13, 2000

(51) Int. Cl.[7] ..... H01J 35/00

(52) U.S. Cl. ..... 378/119; 378/143; 372/5; 372/76; 372/87

(58) Field of Search ..... 378/119, 143; 372/5, 76, 87, 38.05

(56) References Cited

U.S. PATENT DOCUMENTS

| | | | | |
|---|---|---|---|---|
| 3,609,434 A | | 9/1971 | Berry | |
| 4,937,832 A | * | 6/1990 | Rocca | 372/5 |
| 5,499,282 A | | 3/1996 | Silfvast et al. | |
| 5,577,092 A | | 11/1996 | Kubiak et al. | |
| 5,963,616 A | | 10/1999 | Silfvast et al. | |
| 6,031,241 A | | 2/2000 | Silfvast et al. | |

OTHER PUBLICATIONS

Ullmann, J. et al., "Effects of MeV ion irradiation of thin cubic boron nitride films", *Am. Jr. Appl. Physics,* vol. 83, No. 6, 2980–2987 (1998).

Mirkarimi, P.B. et al., "Advances in the reduction and compensation of film stress in high–reflectance multilayer coatings for extreme ultraviolet lithography", SPIE vol. 3331, pp 133–148.

Klosner, M.A. et al., "Intense plasma discharge source at 13.5 nm for extreme–ultraviolet lithography", Optic Letters, vol. 22, No. 1, 1997, pp. 34–36.

Kubiak, G.D., et al., "High–power extreme ultraviolet source based on gas jets", SPIE vol. 3331, pp. 81–89.

Klosner, M.A. et al., "Intense xenon capillary discharge extreme–ultraviolet source in the 10–16–nm–wavelength region", Optics Letters, vol. 23, No. 20, 1998, pp. 1609–1611.

Silfvast, W.T., et al., "High–power plasma discharge source at 13.5 nm and 11.4 nm for EUV lithography", Proceedings of SPIE, Yuli Vladimirsky, 3676, pp 272–275, 1999.

Dedkov, V.S. et al., "Properties of Rhombohedral Pyrolytic Boron Nitride", Inorganic Materials, vol. 32, No. 6, 1996, pp. 609–614.

Duclaux, L., et al. "Structure and low–temperature thermal conductivity of pyrolytic boron nitride", Physical Review B, vol. 46, No. 6, 1992, pp. 3362–3367.

Moore, A.W., "Compression Annealing of Pyrolytic Boron Nitride" Nature "Letters to the Editor", vol. 221, 1969, pp 1133–1134.

* cited by examiner

*Primary Examiner*—Drew Dunn
(74) *Attorney, Agent, or Firm*—Burns Doane Swecker & Mathis LLP

(57) ABSTRACT

An extreme ultraviolet and soft x-ray radiation electric capillary discharge source that includes a boron nitride housing defining a capillary bore that is positioned between two electrodes one of which is connected to a source of electric potential can generate a high EUV and soft x-ray radiation flux from the capillary bore outlet with minimal debris. The electrode that is positioned adjacent the capillary bore outlet is typically grounded. Pyrolytic boron nitride, highly oriented pyrolytic boron nitride, and cubic boron nitride are particularly suited. The boron nitride capillary bore can be configured as an insert that is encased in an exterior housing that is constructed of a thermally conductive material. Positioning the ground electrode sufficiently close to the capillary bore outlet also reduces bore erosion.

19 Claims, 4 Drawing Sheets

EXTREME-UV ELECTRICAL DISCHARGE SOURCE

This invention was made with Government support under Contract No. DE-AC04-94AL85000 awarded by the U.S. Department of Energy to Sandia Corporation. The Government has certain rights to the invention.

FIELD OF THE INVENTION

This invention relates generally to the production of extreme ultraviolet and soft x-rays with an electric discharge source for projection lithography.

BACKGROUND OF THE INVENTION

The present state-of-the-art for Very Large Scale Integration ("VLSI") involves chips with circuitry built to design rules of 0.25 $\mu$m. Effort directed to further miniaturization takes the initial form of more fully utilizing the resolution capability of presently-used ultraviolet ("UV") delineating radiation. "Deep UV" (wavelength range of $\lambda$=0.3 $\mu$m to 0.1 $\mu$m), with techniques such as phase masking, off-axis illumination, and step-and-repeat may permit design rules (minimum feature or space dimension) of 0.18 $\mu$m or slightly smaller.

To achieve still smaller design rules, a different form of delineating radiation is required to avoid wavelength-related resolution limits. One research path is to utilize electron or other charged-particle radiation. Use of electromagnetic radiation for this purpose will require x-ray wavelengths. Various x-ray radiation sources are under consideration. One source, the electron storage ring synchrotron, has been used for many years and is at an advanced stage of development. Synchrotrons are particularly promising sources of x-rays for lithography because they provide very stable and defined sources of x-rays, however, synchrotrons are massive and expensive to construct. They are cost effective only when serving several steppers.

Another source is the laser plasma source (LPS), which depends upon a high power, pulsed laser (e.g., a yttrium aluminum garnet ("YAG") laser), or an excimer laser, delivering 500 to 1,000 watts of power to a 50 $\mu$m to 250 $\mu$m spot, thereby heating a source material to, for example, 250,000° C., to emit x-ray radiation from the resulting plasma. LPS is compact, and may be dedicated to a single production line (so that malfunction does not close down the entire plant). The plasma is produced by a high-power, pulsed laser that is focused on a metal surface or in a gas jet. (See, Kubiak et al., U.S. Pat. No. 5,577,092 for a LPS design.)

Discharge plasma sources have been proposed for photolithography. Capillary discharge sources have the potential advantages that they can be simpler in design than both synchrotrons and LPS's, and that they are far more cost effective. Klosner et al., "Intense plasma discharge source at 13.5 nm for extreme-ultraviolet lithography," Opt. Lett. 22, 34 (1997), reported an intense lithium discharge plasma source created within a lithium hydride (LiH) capillary in which doubly ionized lithium is the radiating species. The source generated narrow-band EUV emission at 13.5 nm from the 2-1 transition in the hydrogen-like lithium ions. However, the source suffered from a short lifetime (approximately 25–50 shots) owing to breakage of the LiH capillary.

Another source is the pulsed capillary discharge source described in Silfvast, U.S. Pat. No. 5,499,282, which promised to be significantly less expensive and far more efficient than the laser plasma source. However, the discharge source also ejects debris that is eroded from the capillary bore and electrodes. An improved version of the capillary discharge source covering operating conditions for the pulsed capillary discharge lamp that purportedly mitigated against capillary bore erosion is described in Silfvast, U.S. Pat. No. 6,031,241.

Debris generation remains one of the most significant impediment to the successful development of the capillary plasma discharge sources in photolithography. Debris generated by the capillary tends to coat optics used to collect the EUV light which severely affects their EUV reflectance. Ultimately, this will reduce their efficiency to a point where they must to be replaced more often than is economically feasible. The art is in search of capillary plasma discharge sources that do not generate significant amounts of debris.

SUMMARY OF THE INVENTION

The present invention is based in part on the demonstration that constructing the capillary bore of an extreme ultraviolet electric plasma discharge with boron nitride can significantly reduce the amount of debris generated. A corollary feature is that the flux of radiation produced is also increased. Applications for the inventive light source include, for example, commercial EUV lithography, microscopy, metrology, and mask inspection.

In one embodiment, the invention is directed to an extreme ultraviolet and soft x-ray radiation electric discharge plasma source that includes:

(a) a body made of boron nitride that defines a capillary bore that has a proximal end and a distal end;

(b) a first electrode defining a channel that has an inlet that is connected to a source of gas and an outlet end that is in communication with the distal end of the capillary bore;

(c) a second electrode positioned to receive radiation emitted from the proximal end of the capillary bore and having an opening through which radiation is emitted; and (d) a source of electric potential that is connected across the first and second electrodes.

In another embodiment, the invention is directed to a method of producing extreme ultra-violet and soft x-ray radiation that includes the steps of:

(a) providing an electric discharge plasma source that includes:

(i) a body made of boron nitride that defines a capillary bore that has a proximal end and a distal end;

(ii) a first electrode defining a channel that has an inlet that is connected to a source of gas and an outlet end that is in communication with the distal end of the capillary bore;

(iii) a second electrode that is positioned adjacent to the proximal end of the capillary bore and defining an orifice;

(iv) a source of electric potential that is connected across the first and second electrodes; and (v) a second housing that defines a vacuum chamber that is in communication with the orifice;

(b) introducing gas from the source of gas into the channel of the first electrode and into the capillary bore; and (c) causing an electric discharge in the capillary bore sufficient to create a plasma within the capillary bore thereby producing radiation of a selected wavelength.

Preferred boron nitrides for the housing are in the form of pyrolytic boron nitride, compression annealed pyrolytic boron nitride, and cubic boron nitride.

Capillary bore materials used in previous electrical discharge sources have suffered from significant bore erosion and debris generation at all operating conditions of interest for EUV photolithography. The intense plasma generated in the capillary bore tends to heat the capillary walls above the melting temperatures of most materials. Depending on the material used, this causes the bore surface either to vaporize directly or to repeatedly melt and freeze. This cyclic melting and freezing changes the material's crystalline structure. Moreover, significant stresses are introduced near the surface of the capillary by intense thermal gradients generated during the discharge cycle. The combination of these stresses and the change in the materials structure cause chunks of material to break off from the surface. Both the vaporization and fracturing tend to increase the capillary bore diameter and generate unwanted debris. This debris streaming in from the walls also tends to cool the plasma. This cooling effect is thought to be responsible for an abrupt decline in EUV emission observed during the discharge cycle. Because boron nitride, e.g., pyrolytic boron nitride, has a higher melting temperature and lower vapor pressure and is extremely resistant to fracture under stress, less bore material is expected to be introduced into the plasma resulting in decreased bore erosion and debris generation and increased EUV flux.

In one preferred embodiment, the proximal end of the capillary bore is connected to the nozzle of the second electrode wherein the nozzle has a conical inner surface which radially expands in an outward direction and the conical inner surface has an inlet having a diameter that is larger than the diameter of the proximal end of the capillary bore and the distance from the center of the capillary bore. The nature of the plasma/material interaction in the capillary bore is such that a capillary material with the following characteristics at elevated temperature are required: low vapor pressure, high mechanical strength, low thermal expansion, high thermal conductivity and high dielectric strength. Pyrolytic, compression annealed pyrolytic, and cubic are forms of boron nitride that have been identified as possessing these properties.

In another preferred embodiment, the housing comprises an inner core made of boron nitride that has a capillary bore and an outer member, positioned around the inner core and that is made of a more thermally conductive dielectric material.

DETAILED DESCRIPTION OF THE INVENTION

Figure 1:
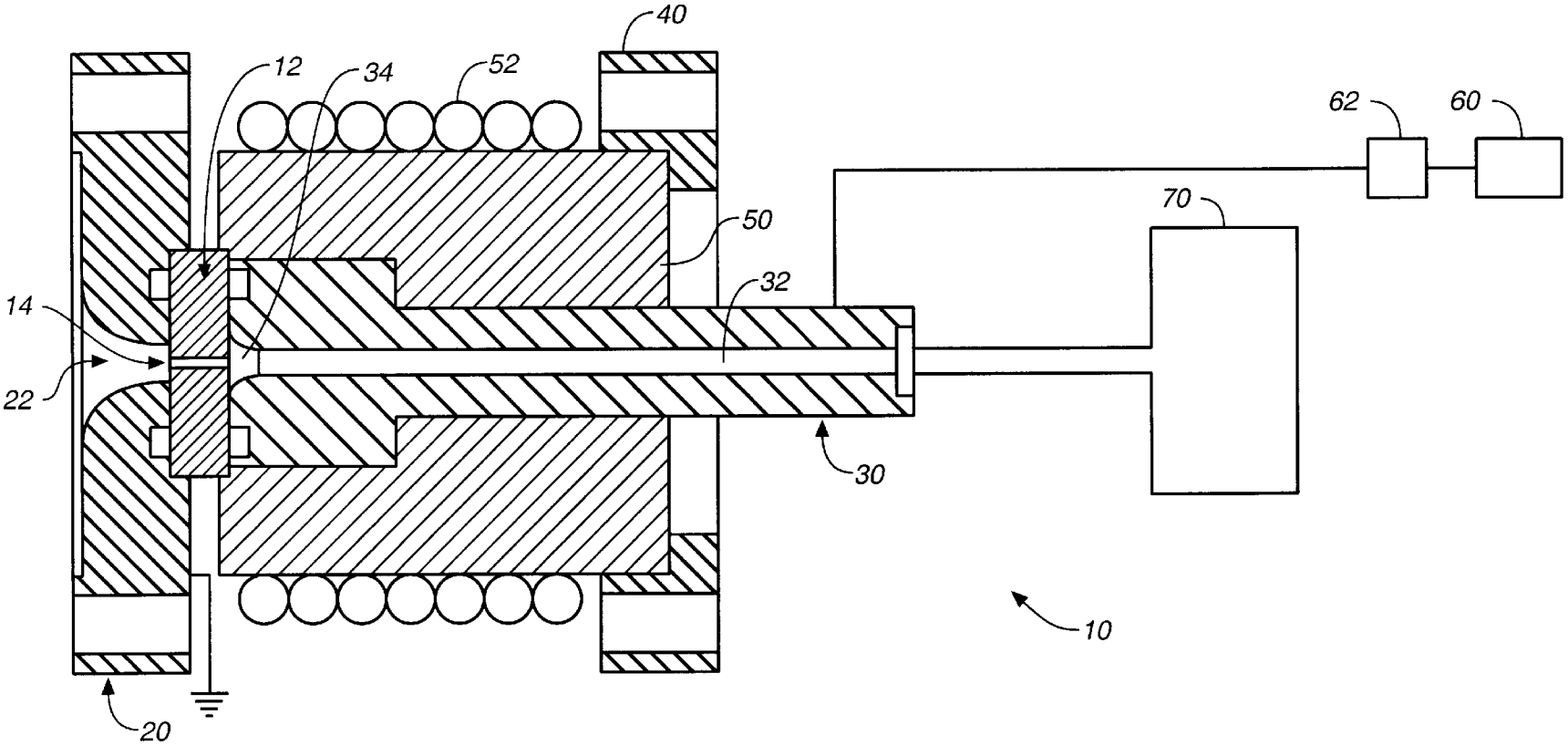
FIG. 1 is a cross sectional view of an electric capillary source.

FIG. 1 is a cross-sectional view of an electric capillary discharge source 10 which preferably comprises an insulating disk 12 that has a capillary bore 14 which is centered on-axis. The disk 12 is mounted between two electrodes 20 and 30 which are in proximity to the front and back surfaces of the disk, respectively. The disk is made of a ceramic material, preferably, boron nitride, and more preferably of pyrolytic boron nitride, compression annealed pyrolytic boron nitride, or cubic boron nitride. These materials are commercially available from Advanced Ceramics of Cleveland, Ohio. It has been demonstrated that boron nitride, which is relatively highly thermally conductive (for a ceramic), is particularly suited for use in the electric discharge source because of its exceptional resistance to erosion. Boron nitride and particularly pyrolytic boron nitride are known in the art and are described, for example, in Dedkov et al., *Properties of Rhombohedral Pyrolytic Boron Nitride, Inorganic Materials,* Vol. 32, No. 6 1996 (609–614), Duclaux et al., *Structure and Low-Temperature Thermal Conductivity of Pyrolytic Boron Nitride, The Am. Phy. Soc. Physical Review B,* Vol. 46, No. 6, 1992 (3362–3367), A. M. Moore, *Compression Annealing of Pyrolytic Boron Nitride, Nature,* Vol. 221, 1969 (1133–1134), which are all incorporated herein by reference.

Front electrode 20 is typically grounded and has an aperture 22 having a center that is aligned with the center of the capillary bore 14. Rear electrode 30 has a channel 32 with an inlet and an outlet 34. The outlet 34 is connected to the capillary bore at the back end of disk 12 while the inlet is connected to a gas source 70. Rear electrode 30 is also connected to a source of electric potential 60 which includes a switch mechanism 62 to generate electric pulses. To facilitate the removal of heat, front and rear electrodes and capillaries are preferably encased in a thermally conductive housing 50 which in turn can be surrounded by coils 52 through which a coolant, e.g., water, is circulated. Flange 40 is secured to an outer edge of the conductive housing 50. Front and rear electrodes are made of any suitable electrically conductive and erosion resistant material such as refractory metals, e.g., stainless steel.

The electric capillary discharge source 10 employs a pulsed electric discharge in a low-pressure gas to excite a plasma confined within a capillary bore region. A high-voltage, high-current pulse is employed to initiate the discharge thereby creating a plasma, e.g., 2–50 eV, that radiates radiation in the EUV region. The source of gas 70 contains any suitable gas that can be ionized to generate a plasma from which radiation of the desired wavelength occurs. For generating extreme ultraviolet radiation and soft x-rays, xenon is preferred.

Figure 2A:
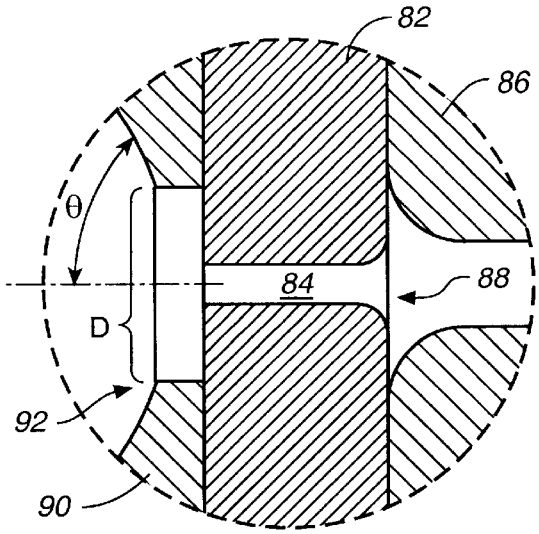
FIGS. 2A and 2B illustrate electrode/capillary bore configurations.
Figure 2B:
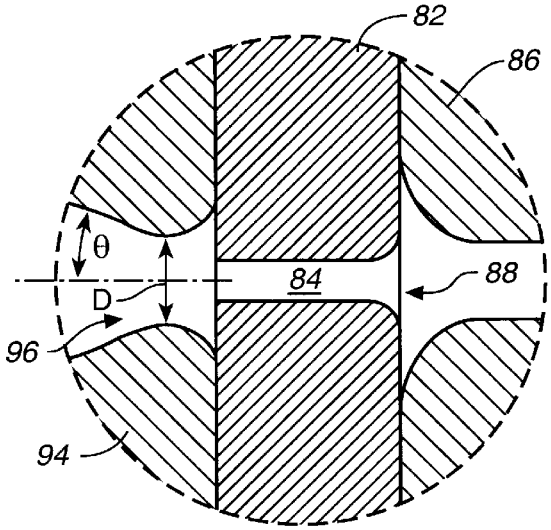

FIGS. 2A and 2B depict alternative preferred configurations of the front electrode; each electrode contacts the front surface of the insulating disk 12 of FIG. 1. These configurations represent the shape of the components prior to operation of the electrical discharge source. In both arrangements, ceramic disk 82 has capillary bore 84 that extends through its center. Similarly, rear electrode 86 has a channel 88 that extends through its center. Both capillary bore 84 and channel 88 preferably have circular cross-sections with the diameter of channel 88 being larger than that of capillary bore 84. The ceramic disk and rear electrode are positioned so that xenon gas can readily flow through channel 88 and into capillary bore 84. As shown in FIGS. 2A and 2B, the diameter of channel 84 is uniform throughout including the outlet end. With respect to the embodiment shown in FIG. 2A, the front electrode 90 has a channel 92 that extends through the center of front electrode. The channel is configured as an expanding nozzle so that gas and radiation can be readily emitted from the capillary bore.

Similarly, for the embodiment shown in FIG. 2B, the front electrode 94 has a channel 96 that extends through the center of front electrode. The channel is also configured as an expanding nozzle so that gas and radiation can be readily emitted from the capillary bore. The nozzles of both embodiments, are preferably configured to define a cone where the angle between the center axis and the interior side ranges from about 17° to 75°. As illustrated in FIG. 2A, this angle θ is about 60° (and preferably ranges from about 45° to 75°) and in FIG. 2B, this angle θ is about 22° (and preferably ranges from about 17° to 27°).

Figure 3A:
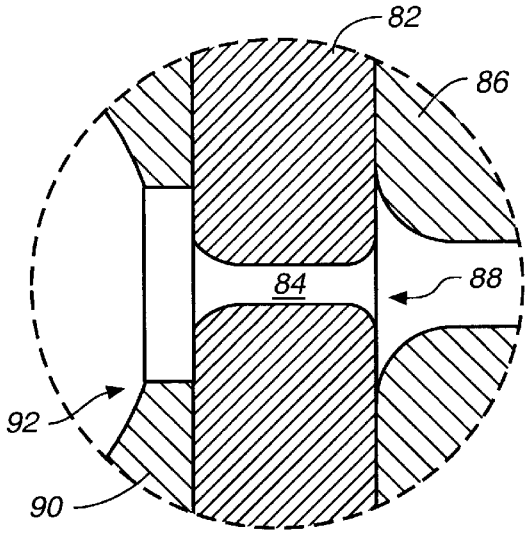
FIGS. 3A and 3B illustrate electrode/capillary bore configurations after operations of the electric discharge source.
Figure 3B:
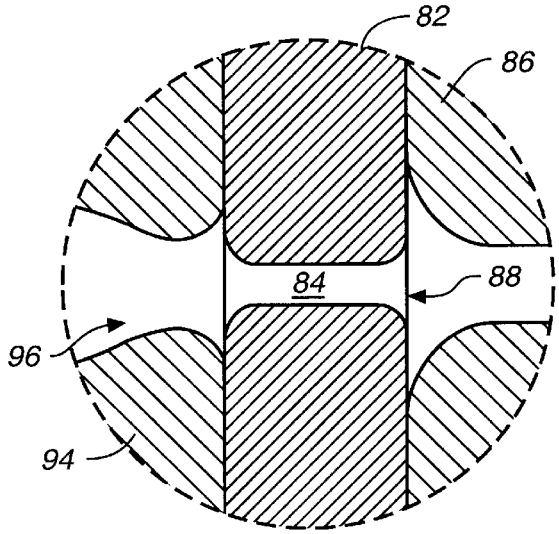

The relative distance from the front electrode 90 to capillary bore 84 of the embodiment of FIG. 2A is greater than the distance from the front electrode 94 to capillary bore 84 of FIG. 2B. It has been found that the electrode configuration of FIG. 2B results in less capillary bore erosion during operation of the electrical discharge source. FIGS. 3A and 3B depict typical configurations of the front electrode/capillary bore assembly of FIGS. 2A and 2B, respectively, after 100,000 pulses or "shots" of an electric discharge source device. The capillary bore was fabricated of pyrolytic boron nitride and the electrodes were made of stainless steel. Further, for the configuration shown in FIG. 2A, the capillary bore 84 had a diameter of 1.5 mm and the diameter D of the front electrode was ¼ in. (6.4 mm). Typically the ratio of D to the capillary bore diameter should range from about 2:1 to 6:1. For the configuration shown in FIG. 2B, the capillary bore 84 also had a diameter of 1.5 mm and the diameter D of the front electrode was 3 mm. Typically the ratio of D to the capillary bore diameter D should range from about 1:1 to 6:1.

As is evidenced by the bevel shapes of the front section of the capillary bores shown in FIGS. 3A and 3B, a higher level of capillary bore erosion occurred at the front section of the capillary bore 84 when the front electrode 90 is positioned farther away from the capillary bore 84 as shown in the configuration of FIG. 2A as opposed to the configuration illustrated in FIG. 2B. The capillary bore erosion bevel patterns for the back section of the capillary bores were similar. In light of this, to reduce the amount of debris generated, the ceramic disk 82 can be fabricated so that the front section and/or back section of the capillary bore 82 has bevel configuration(s) similar to that shown in FIGS. 3A and 3B.

It is believed that the different capillary bore erosion patterns are attributable to the difference in current paths that exist near the capillary bore exit. Specifically, during a pulse electric discharge, current travels between the front and rear electrodes. If the front electrode is far away from the capillary bore, the current must take a more circuitous path around the perimeter of the capillary bore exit thereby creating a pronounced erosion pattern with the concomitant generation of debris.

Figure 4:
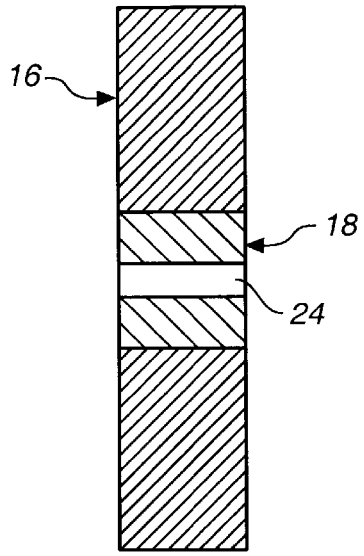
FIG. 4 is a cross sectional view of a housing member having a capillary insert that defines the capillary bore.

As shown in FIG. 1, the capillary bore 14 is fabricated within an insulating disk 12 that essentially comprises a single structure with a bore in the middle. FIG. 4 illustrates an alternative embodiment of the capillary bore bearing device that can be employed in the electric discharge source in place of the insulating disk 12. The capillary bore device comprises an outer disk or casing 16 that is made of a high thermal conductivity material such as, a metal or ceramic. The capillary bore device further includes an inner disk 18 that has a capillary bore 24 that extends through the center of the inner disk. The inner disk 18 is an insert or plug that is made of any dielectric material that is suitable for use in an electric discharge source. The ceramic material has good erosion resistant characteristics but has a relatively low coefficient of thermal conductivity. Preferred materials are pyrolytic boron nitride, hot pressed pyrolytic boron nitride, and cubic boron nitride. With this capillary bore device, only the inner disk or insert needs to be replaced after the capillary bore has eroded. The outer disk serves to dissipate heat generated in the capillary bore.

In another embodiment, outer disk 16 of the device shown in FIG. 4 is fabricated of metal that is coated with a dielectric material on the outside faces. Alternatively, the outer disk can be fabricated from pyrolytic graphite which is thermally conductive and electrically conductive. In this case, the face of the outer disk is most preferably coated with an insulator to prevent electric current from conducting through. Another approach is to construct the inner disk 18 with diamond or to the coat the outer disk 16 with diamond or pyrolytic boron nitride. In the latter case, inner disk or insert 18 would not be needed. While this approach employs materials that are expensive, only a relatively small amount is needed to obtain the good insulating properties of these materials.

EXPERIMENTAL

Figure 5:
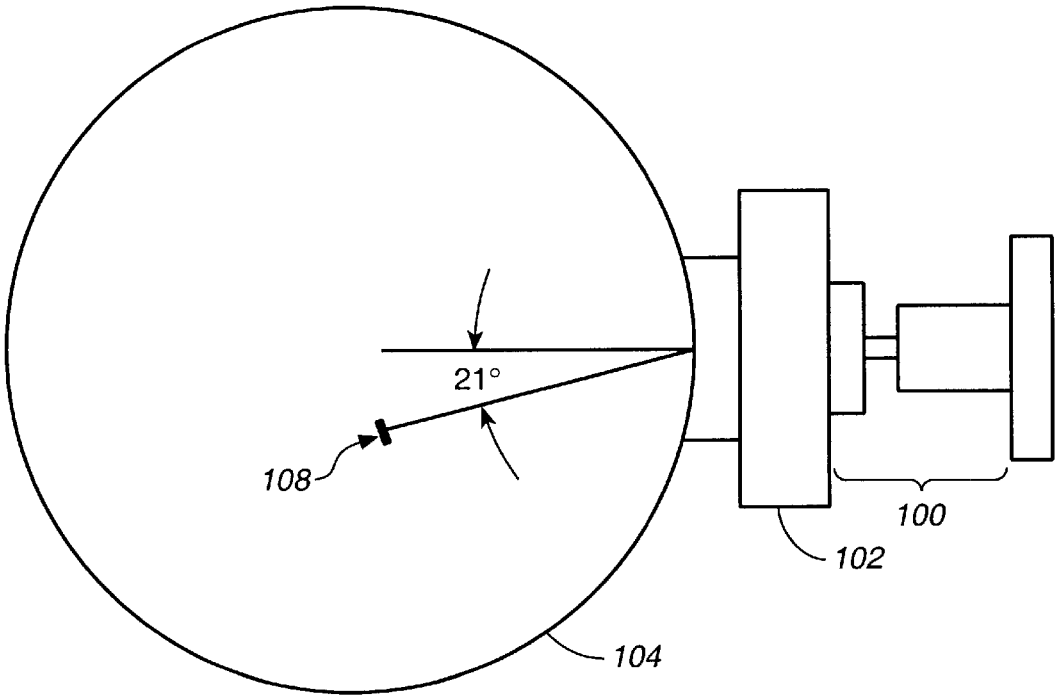
FIG. 5 is a schematic of an electric discharge system.

FIG. 5 illustrates an electric discharge system that was employed to the test the inventive electric discharge source. The system included an electric discharge source 100, like the one illustrated in FIG. 1, which is connected to a processing chamber 104, by flange 102. The processing chamber was maintained at a sub-atmospheric pressure at about 0.1 mTorr. (Typically, the pressure is approximately $1\times10^{-3}$ Torr or less.) The source was operated with a xenon gas pressure at about 1.5 Torr. The rear electrode was coupled to a high-voltage pulser capable of producing discharge current of 5 kA for a duration of approximately 1 μsec. (Typically the pulse duration ranges from about 0.5 to 4 μsec.) The discharge was initiated by a triggered spark gap incorporated into the pulser unit operating at 20 Hz. A Rogowski coil monitored the discharge-current pulse. The electric discharge source employed 6 mm long, 25 mm diameter outer insulating disk that had a 1.5 mm diameter capillary bore.

Figure 6:
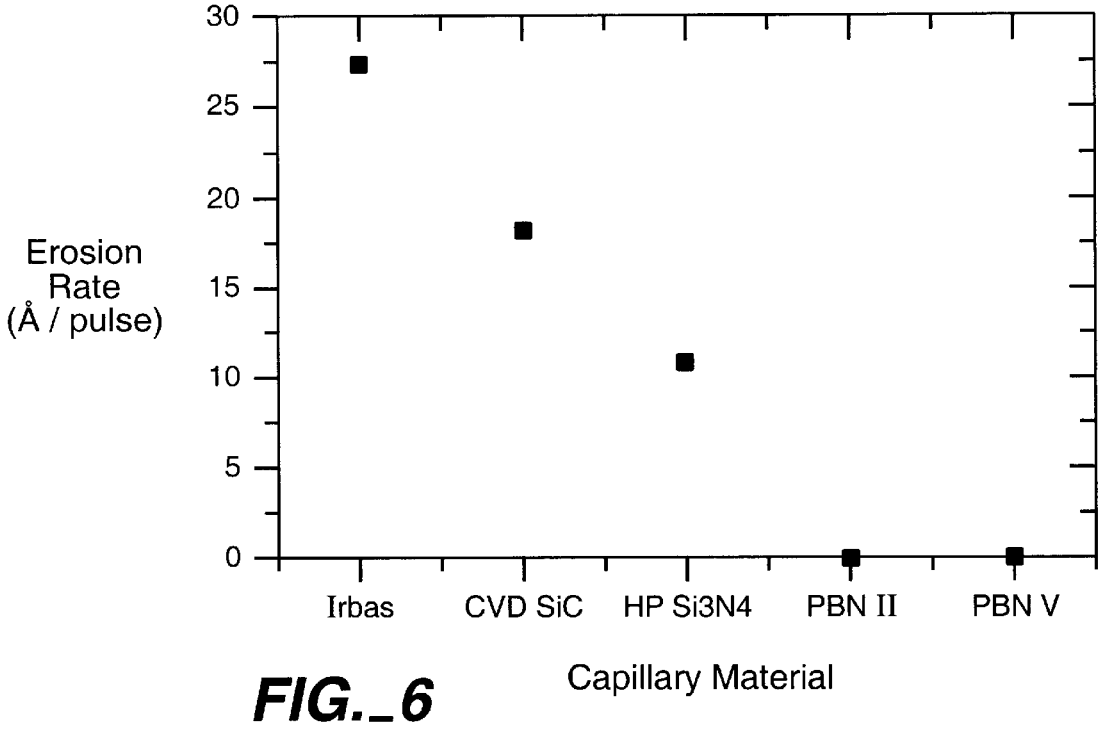
FIG. 6 is a graph of erosion rate of a capillary bore vs. capillary bore material.

In one set of experiments, erosions rates of the capillary bores in disks that were made from 4 different materials, namely: (1) in situ reinforced barium aluminosilicate (Irbas), (2) silicon carbide made by chemical vapor deposition (CVD SiC), (3) hot pressed silicon nitride ($HPSi_3N_4$), (4) two samples of pyrolytic boron nitride which was obtained from Advanced Ceramics. Backlighting the capillary bores was used to photograph the outlet ends of the capillary bores, which would be positioned adjacent the front electrode, (1) before operation of the electrical discharge source and (2) after 100,000 pulses (or shots). The pre- and post operation diameters of the capillary bores were measured from the photographs and the erosion rates (Angstrom/pulse) of the capillary bores were ascertained therefrom. FIG. 6 presents the erosion rate data for the various materials tested. As evident, the bore erosion rates for the pyrolytic boron nitride disks were significantly less than those made from other materials.

In the same experimental, a silicon deposition substrate 108 ("witness plate") was positioned in the processing chamber 104 as shown in FIG. 5. The witness plate was positioned 21 degrees off axis from the center line from the capillary bore and 14 cm from the capillary bore exit. The witness plate is placed at a preferred location where collector mirrors of a condenser would be placed in an EUV photolithography system. In this test, the electric discharge source employed insulating disks that were made from aluminum nitride (AlN) in addition to the materials described above. After 100,000 shots of the electric discharge source, the silicon witness plate was removed and the deposited film analyzed by sputter depth profiling with Auger Electron Spectroscopy to establish film composition and depth.

Figure 7:
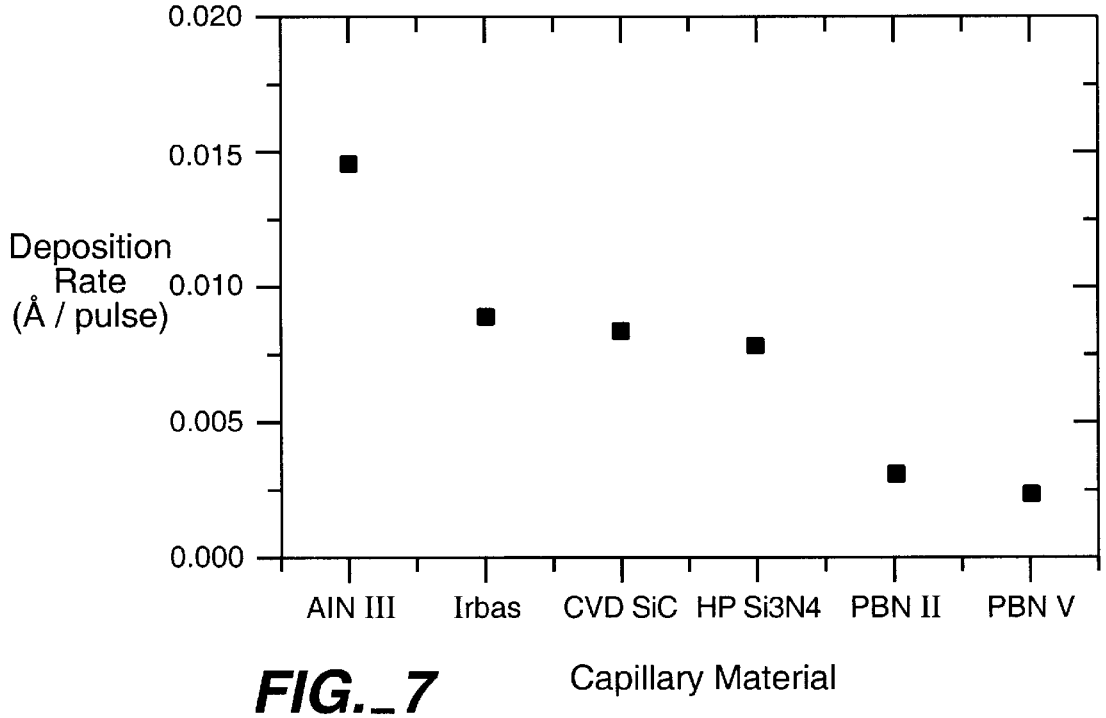
FIG. 7 is a graph of debris deposition rates from an electrical discharge source vs. capillary bore material.

As shown in FIG. 7, debris generation from capillary bores in disks made of pyrolytic boron nitride, as measured by the thickness of the deposit on the witness plates, was reduced by about a factor of 3–6 over the other dielectric materials tested. It was also found that over 3 times more flux was generated on axis using pyrolytic boron nitride disk as compared to AlN at 5 kA peak current.

Although only preferred embodiments of the invention are specifically disclosed and described above, it will be appreciated that many modifications and variations of the present invention are possible in light of the above teachings and within the purview of the appended claims without departing from the spirit and intended scope of the invention.

What is claimed is:

1. An extreme ultraviolet and soft x-ray radiation electric discharge plasma source that comprises:

(a) a body made of boron nitride that defines a capillary bore that has a proximal end and a distal end;

(b) a first electrode defining a channel that has an inlet that is connected to a source of gas and an outlet end that is in communication with the distal end of the capillary bore;

(c) a second electrode at a reference potential positioned to receive radiation emitted from the proximal end of the capillary bore and having an opening through which radiation is emitted; and (d) a source of electric potential that is selectively connectable to the first electrode.

2. The discharge plasma source of claim 1 wherein the boron nitride is selected from the group consisting of pyrolytic boron nitride, compression annealed pyrolytic boron nitride, and cubic boron nitride.

3. The discharge plasma source of claim 1 wherein the inlet of the first electrode is connected to a source of xenon.

4. The discharge plasma source of claim 1 wherein the second electrode is grounded.

5. The discharge plasma source of claim 1 where at least one of the proximal end or distal end of the capillary bore has a bevel configuration or rounded corners.

6. The discharge plasma source of claim 1 wherein the proximal end of the capillary bore has an opening that is in communication with the opening of the second electrode wherein the opening radially expands in an outward direction.

7. The discharge plasma source of claim 6 wherein the opening has an inlet having a diameter $D_1$ that is larger than the diameter $D_2$ of the proximal end of the capillary bore and the ratio of $D_1$ to $D_2$ ranges from greater than 1:1 up to and including 6:1.

8. The discharge plasma source of claim 6 wherein the proximal end of the capillary bore has a circular cross section and wherein the diameter of the proximal end is smaller than that of conical inner surface of the nozzle.

9. The discharge plasma source of claim 1 wherein the body comprises (i) an inner core formed of a first material and which defines the capillary bore and (ii) an outer member that is made of a second material that is more thermally conductive than the first material.

10. The discharge plasma source of claim 1 wherein the body comprises (i) an inner core formed of a first material and which defines the capillary bore and (ii) an outer member that is made of a second material that is more electrically and thermally conductive than the first material, and wherein the outer member surface is coated with an electric insulative material.

11. The discharge plasma of claim 1 wherein the body comprises a member which defines an inner core which has a surface that is coated with a dielectric material.

12. The discharge plasma source of claim 9 wherein the proximal end of the capillary bore has a circular cross section and wherein the diameter of the proximal end is smaller than that of an inner surface of the opening.

13. The discharge plasma source of claim 9 wherein the boron nitride is selected from the group consisting of pyrolytic boron nitride, compression annealed pyrolytic boron nitride, and cubic boron nitride.

14. A method of producing extreme ultra-violet and soft x-ray radiation that comprises the steps of:

(a) providing an electric discharge plasma source that comprises:

(i) a body made of boron nitride that defines a capillary bore that has a proximal end and a distal end;

(ii) a first electrode defining a channel that has an inlet that is connected to a source of gas and an outlet end that is in communication with the distal end of the capillary bore;

(iii) a second electrode that is positioned to receive radiation emitted from the proximal end of the capillary bore and defining an orifice; and (iv) a source of electric potential that is connected across the first and second electrodes;

(v) a second housing that defines a vacuum chamber that is in communication with the orifice;

(b) introducing gas from the source of gas into the channel of the first electrode and into the capillary bore; and (c) causing an electric discharge in the capillary bore sufficient to create a plasma within the capillary bore thereby producing radiation of a selected wavelength.

15. The method of claim 14 wherein the gas is xenon.

16. The method of claim 14 wherein the pressure within the vacuum chamber during step (c) is less than about $1\times10^{-3}$ Torr.

17. The method of claim 14 wherein step (d) creates a 20 to 50 eV plasma.

18. The method of claim 14 wherein step (d) comprises causing a pulse electric discharge for between about 0.5 to 4 $\mu$sec.

19. The method of claim 14 wherein the boron nitride is selected from the group consisting of pyrolytic boron nitride, compression annealed pyrolytic boron nitride, and cubic boron nitride.

* * * * *